US005636498A

United States Patent [19]

Belanger et al.

[11] Patent Number: 5,636,498

[45] Date of Patent: Jun. 10, 1997

[54] BULK STRAW LOADING SYSTEM

[75] Inventors: Donald R. Belanger, Merrimack; David M. Lorenzo, Londonderry; Ronald L. Downing, Merrimack, all of N.H.

[73] Assignee: George Gordon Associates, Inc., Nashua, N.H.

[21] Appl. No.: 439,918

[22] Filed: May 12, 1995

[51] Int. Cl.[6] ..... B65B 19/34

[52] U.S. Cl. ..... 53/444; 53/148; 53/236; 53/447; 53/540; 53/500; 53/501

[58] Field of Search ..... 53/148, 149, 150, 53/151, 236, 444, 500, 501, 535, 540, 447, 473, 253

[56] References Cited

U.S. PATENT DOCUMENTS

| | | | |
|---|---|---|---|
| 1,523,985 | 1/1925 | Parker | 53/236 |
| 2,068,407 | 1/1937 | Goldstein et al. | 53/444 X |
| 3,535,847 | 10/1970 | Strohmeier et al. | 53/501 |
| 3,854,270 | 12/1974 | Cloud et al. | 53/540 |
| 3,956,982 | 5/1976 | Hill et al. | 53/535 X |
| 4,031,999 | 6/1977 | Wagner et al. | 53/500 X |
| 4,174,029 | 11/1979 | Kawaguchi et al. | 53/148 X |
| 4,183,192 | 1/1980 | Smaw | 53/501 X |
| 5,081,823 | 1/1992 | van der Ent | 53/501 |
| 5,178,225 | 1/1993 | Anderson et al. | 53/236 X |
| 5,265,398 | 11/1993 | VanAlstine et al. | 53/148 X |

*Primary Examiner*—Daniel Moon

*Attorney, Agent, or Firm*—Daniel J. Bourque; Kevin J. Carroll

[57] ABSTRACT

A bulk straw loading system includes one or more bulk straw staging members having a plurality of compartments which receive, organize and store straws. The straws are detected and counted as they are received. A bulk straw staging member compartment opening temporary closure device insures that at least two compartments full of straws can be stored in a bulk straw staging member prior to being unloaded to a bulk straw transport device. A bulk straw transport device provides the straws to a bulk straw packager such as a boxer or bagger. A bulk straw loading system controller utilizes straw manufacturing speed information from a straw extruder, cutter or wrapper and combined with straw count information, effectuates rotation of each bulk straw staging member as appropriate. The controller also controls the bulk straw transport system by controlling air or hydraulic cylinders which move one or more bulk straw transport devices between a first position which under the bulk straw staging member and a second position proximate the bagger or boxer.

20 Claims, 7 Drawing Sheets

BULK STRAW LOADING SYSTEM

FIELD OF THE INVENTION

This invention relates to packaging systems and more particularly, to a system for bulk packaging straws.

BACKGROUND OF THE INVENTION

Inexpensive and disposable plastic straws are widely used in the fast food and restaurant industry, schools, hospitals, and other institutions and commercial or residential establishments. In order to accommodate the need and demand for such disposable straws, large extruding systems are typically utilized which can produce up to 2,000 straws per minute.

Plastic straws are typically extruded in a long stream, cut, sometimes wrapped in paper, and forwarded to a packaging area or center. Presently, plastic straws are received from a cutter, counted, staged in a holding area as a predetermined number of straws, whereupon they are hand inserted into a box, bag or other bulk package.

This method requires a tremendous amount of manual labor in gathering and packaging the straws, which adds considerably to the price of the straws. Additionally, handling of the straws is often not desirable due to the possibility of contamination.

Accordingly, what is needed is a system for gathering or staging straws as received from a high speed manufacturing/cutting device, and which automatically counts the straws, provides a predetermined number of straws to a transport device, and finally, which automatically packages the straws, without human intervention.

SUMMARY OF THE INVENTION

This invention includes a bulk straw loading system which includes a bulk straw staging member, which is coupled to a source of straws. Typically, straws are plastic straws received from a plastic straw extruder. The straws may be wrapped or unwrapped and in either case are cut to length.

The bulk straw staging member includes a plurality of bulk straw staging member compartments, each of the bulk straw staging member compartments are designed to contain or hold a plurality of straws. Typically, each bulk straw staging member compartment is large enough to stage or hold a predetermined number of straws. The predetermined number of straws is at least equal to the number of straws that are generally packaged in a box of bag.

The present invention also includes a bulk straw staging member rotator, coupled to the bulk straw staging member, for effecting rotational movement of the bulk straw staging member. A bulk straw transport device is coupled to the bulk straw staging member, for receiving the plurality of counted straws from each successive rotated bulk straw staging member compartment, and for transporting the straws to a bulk straw packager.

The bulk straw loading system according to the present invention also includes a bulk straw loading system controller, coupled to at least the bulk straw staging member and a bulk straw transport controller, and responsive to at least an indication of a rate at which the straws are being received by the bulk straw staging member, for controlling the bulk straw staging member rotator thereby controlling rotational movement of the bulk straw staging member, and for controlling transport of the received straws by the bulk straw transport device.

In the preferred embodiment, the bulk straw staging member includes a wheel, preferably disposed vertically but which may also be disposed horizontally. The wheel includes a plurality of compartments which are preferably triangular shaped but which may also be rectangular or other shape as desired.

The preferred embodiment also includes a bulk straw staging member compartment opening temporary closure member, which is disposed or located proximate at least two openings of each bulk straw staging member compartment, for temporarily closing the at least two compartments after the compartments have received a predetermined number of straws, and prior to the time the straws are discharged to the bulk straw transport device.

The present embodiment also contemplates that the bulk straw staging member includes a straw counter or detector, for indicating to the bulk straw loading system controller the amount of straws that have been received by the bulk straw staging member.

The bulk straw transport device of the present invention may be fully coupled to a bulk straw packager, for boxing, bagging or otherwise enclosing a predetermined quantity of straws to be packaged by the packager.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
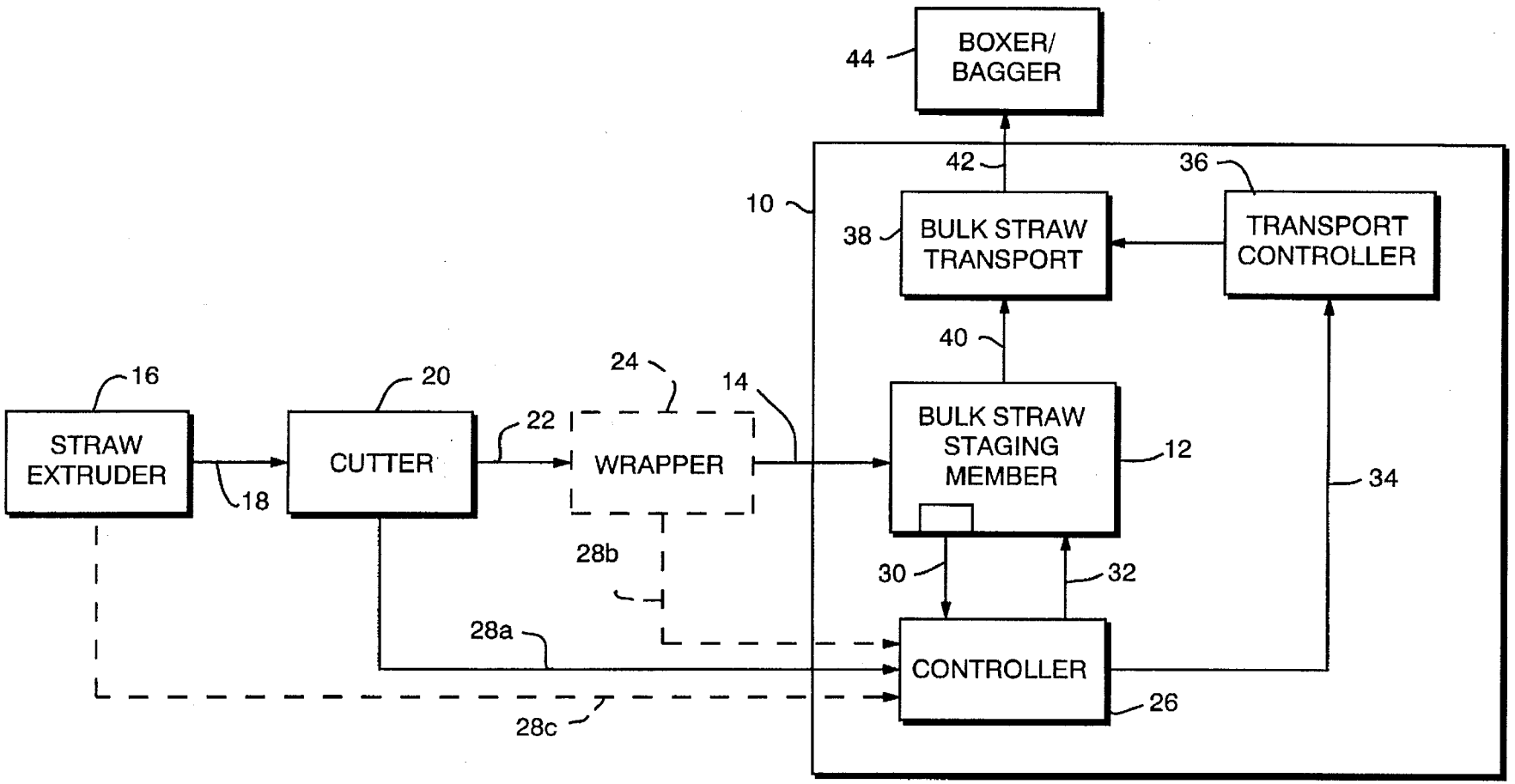
FIG. 1 is a schematic block diagram of the bulk straw loading system according to the present invention, interfaced with a bulk straw extruder, cutter, wrapper and boxer/bagger.

The present invention features a bulk straw loading system 10, FIG. 1, including at least one bulk straw staging member 12 which is coupled to a source of straws 14. The bulk straw staging member 12 of the present invention is typically coupled to a source of straws 14, such as a plastic straw extruder 16 as is well known in the art, which provides a stream or length of straw material 18 of many feet in length. A cutter mechanism 20 such as a Gatto Cutter, well known in the art, receives the stream or length of straw material 18 and cuts the stream into a plurality of straws 22. The straws may optionally be wrapped by a straw wrapper 24 before being provided 14 through the bulk straw staging member 12.

The bulk straw loading system 10, in accordance with the present invention, further includes a bulk straw loading system controller 26, which receives as input a signal 28 from at least one of cutter 20, extruder 16 and wrapper 24 which indicates the speed at which the straws are being provided 14 to the bulk straw staging member 12. The bulk straw loading system controller also receives an input an indication 30 from the bulk straw staging member 12 each time a straw is received from the source 14 and enters the bulk straw staging member 12.

Utilizing the information input to the bulk straw loading system controller 26, the controller provides a bulk straw staging member rotator signal 32 causing the bulk straw staging member 12 to index or rotate to provide a new compartment to the source of straws 14 as will be explained in greater detail below.

The bulk straw loading system controller 26 also provides a transport device control signal 34 which at least partially controls transport controller 36 to control the bulk straw transport device 38. Bulk straw transport device 38 receives a predetermined count or amount of straws 40 from bulk straw staging member 12 and under control of bulk straw transport controller 36, provides the predetermined number of straws confined in a predetermined shape or organization 42 to a standard boxer or bagger device 44 which is well known in the industry. Boxer or bagger 44 encloses the predetermined number of straws 42 organized in a predetermined pattern into a box or bag, as desired by the user.

Figure 2:
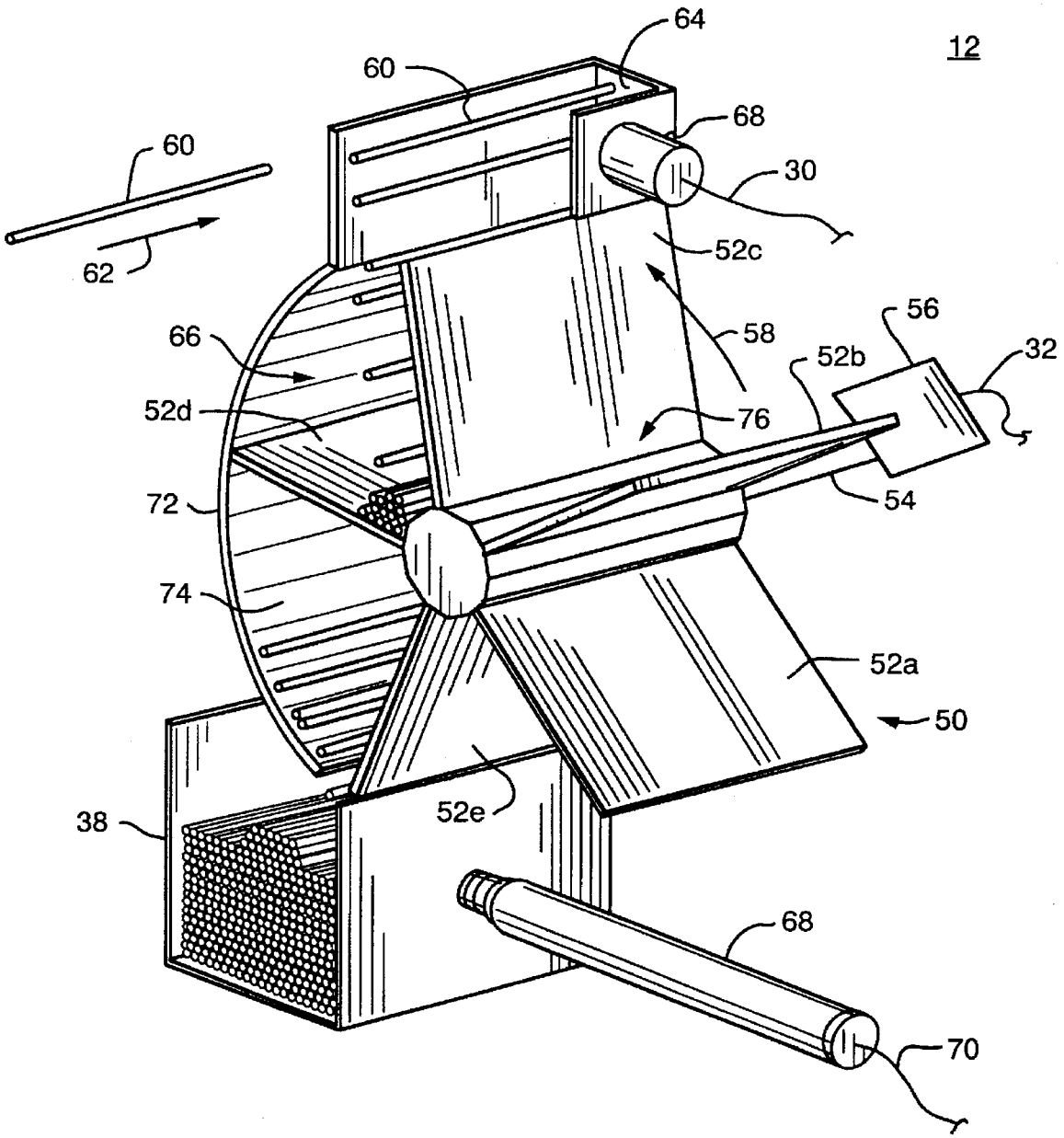
FIG. 2 is a schematic view of a wheel which comprises the preferred embodiment of a bulk straw staging member in accordance with the present invention, which is discharging straws to a bulk straw transport device.

The preferred embodiment of the bulk straw staging member 12, FIG. 2, in accordance with the preferred embodiment includes a wheel or paddle shaped element 50 which includes, in the preferred embodiment, 5 paddle segments 52*a*–52*e*. In the preferred embodiment, each paddle element 52 would have a length or radius of approximately 8 to 9 inches thereby forming a paddle or wheel 50 having a paddle or diameter of approximately 16 to 18 inches, and a circumference of approximately 50 inches.

In the preferred embodiment, each wheel or paddle shaped element 50 as well as the remainder of the bulk straw staging member is preferably constructed of lightweight material, such as plastic, although other material such as aluminum and stainless steel are considered to be within the scope of the present invention.

The paddle or wheel 50 is coupled by a shaft or other similar element 54 to a bulk straw staging member rotator 56, which in the preferred embodiment, includes a motor such as a stepper motor, well known in the art. The motor is coupled by signal receiving path 32 to the bulk straw rolling system controller 26 as previously illustrated. The motor may be controlled to rotate generally continuously or alternatively, may be indexed or stepped in predetermined angle or degree.

Additionally, one or the other, or both, of the paddle or wheel 50 and rotator 56 are supported by appropriate supports (eliminated for the sake of clarity) to hold the assembly in place yet allow the paddle or wheel 50 to rotate in the direction indicated generally by arrow 58.

The bulk straw staging member 12 receives a plurality of straws 60 traveling at a high rate of speed in the direction indicated generally by arrow 62. The straws 60 strike region 64 of the bulk straw staging member 12 which is provided with a thin, approximately ¼ inch, foam or other resilient member to cushion and absorb the energy of the straws 60 traveling in the direction of arrow 62. The straws 60 then fall or drop into a compartment region 56 formed by two paddle or wheel elements such as elements 52*c* and 52*d*, to be collected and staged.

A straw detector 68, coupled by means of signal path 30 to bulk straw loading system controller 26, including a device such as a simple photoelectric cell, detects each straw 60 as it drops into the compartment 66 and provides an indication to the controller 26. This indication, provided over signal path 30, is utilized to control bulk straw staging member rotator or motor 56 over signal path 32 as will be explained in greater detail below.

At the appropriate time, under control of the bulk straw loading system controller 26, the bulk straw staging member 12 is rotated in the direction indicated generally by arrow 58 causing the straws 60 to be unloaded or dispensed into a bulk straw storage device 38 for subsequent transport to a boxer or bagger as will be explained in greater detail below. Movement of the bulk straw transport device 38 is controlled by one or more mechanism such as an air or hydraulic cylinder 68 coupled by one or more hoses 70 to a transport controller 36 including a source of pressurized air or hydraulic oil, values, and circuitry as is well known in the art.

A feature of the bulk straw staging member 12 in accordance with the present invention is the inclusion of a bulk straw staging member compartment temporary closure member 72 which in the preferred embodiment includes a curved member having a length slightly longer than two times the chordal distance forward by the distance between outer edges of two wheel elements such as wheel elements 52*c* and 52*d*. This length allows for the bulk straw staging member compartment temporary closure member 72 to contain, without unloading or dispensing, straws 60 contained in compartment 74 while straws 60 are being staged in compartment 66.

Utilizing the present system, particularly where two bulk straw staging members 12 are utilized with one bulk straw transport device 38 allows the bulk straw transport device 38, to be efficiently constructed to move at relatively low speeds with little wear and tear as compared to the high speed at which the straws 60 are received by the bulk straw staging member 12. For example, although straws 60 may be received at the rate of up to 2,000 straws per minute, and although the bulk straw transport device 38 may take 5 to 10 seconds to cycle, the fact that the bulk straw staging member compartment temporary closure member 72 can hold or stage at least two compartments 66, 74 of straws 60 gives ample time for bulk straw transport device 38 to cycle as will be fully explained below.

Indeed, by insuring that the bulk straw staging member compartment temporary closure member 72 is long enough to enclose at least two bulk straw staging member compartments 66, 74 allows the bulk straw loading system of the present invention to stage nearly three compartments full of straws. When the preferred embodiment or when the paddle or wheel 50 of the bulk straw staging member 12 is disposed vertically, approximately 3/16 inch of rotation of the paddle or wheel 50 will allow straws 60 to be staged or loaded in the next compartment 76 versus the previous compartment 66.

Utilizing this methodology, even if one transport device 38 is servicing two bulk straw staging members 12, the speed of the transport device 12 is of no great significance as long as the transport device 38 can cycle to each bulk straw staging member 12 in the time it takes the straw to fill three compartments 66, 74, 76 of the bulk straw staging member 12 or not more than 1 minute.

Figure 3:
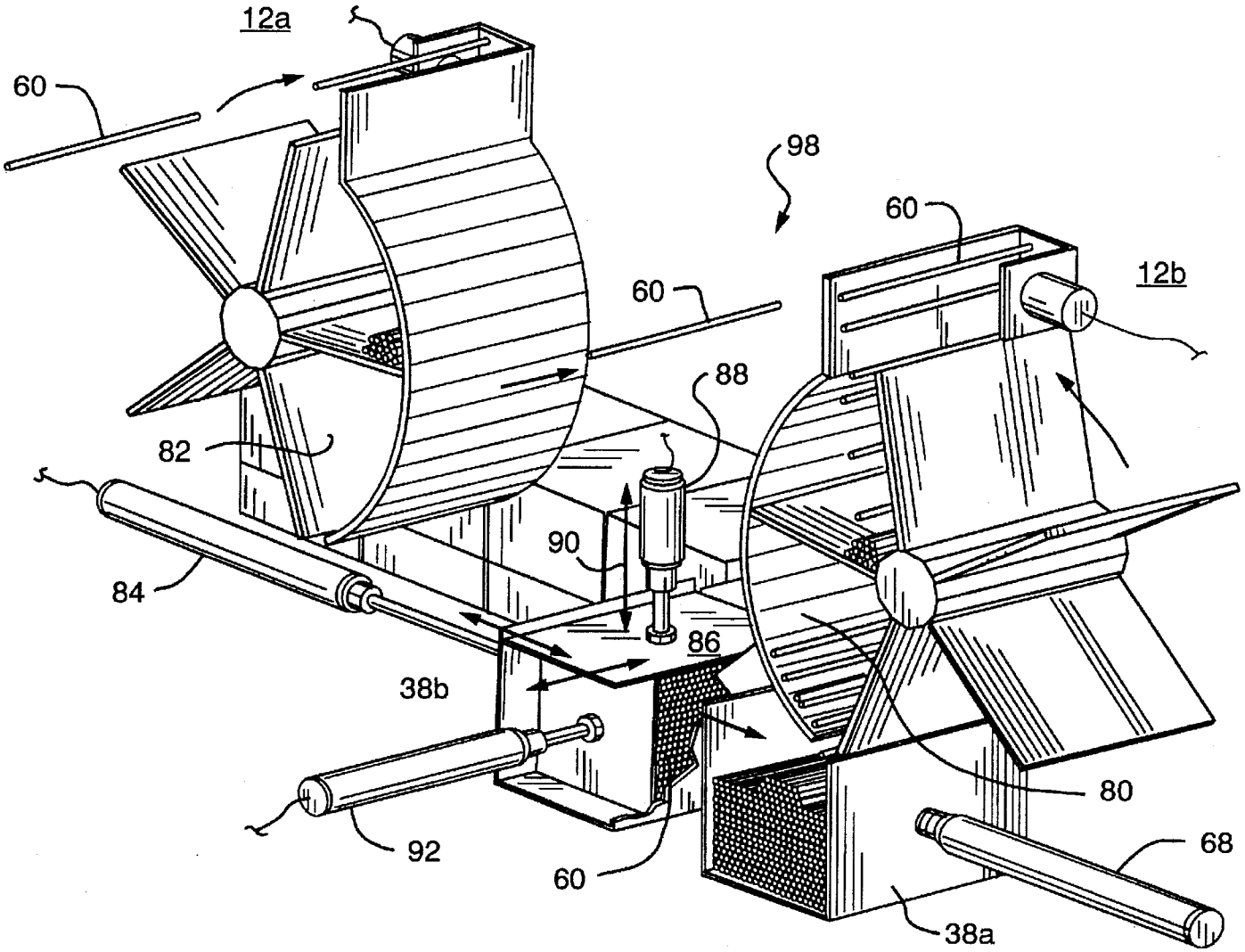
FIG. 3 is a schematic view of two bulk straw staging members and the bulk straw transport device in accordance with the present invention.

In an exemplary preferred embodiment, two bulk straw staging members 12*a*, 12*b*, FIG. 3, are illustrated with the omission of bulk straw staging member support and motors for the sake of clarity. Each bulk straw staging member 12*a*, 12*b* receives a plurality of straws 60 from a source of straws such as an extruder, coupled to a cutter and optionally a wrapper as previously disclosed. A first bulk straw loading system transport device 38*a* is positioned under bulk straw staging member 12*b* wherein straws from compartment 80 are being discharged and stacked in an orderly manner in the first bulk straw transport device 38*a*.

Also illustrated is a second bulk straw transport device 38*b* which contains a plurality of straws 60 which have been discharged from compartment 32 of bulk straw staging member 12*a*. The second bulk straw transport device 38*b* has been moved by a first positioner 84 such as an air or hydraulic cylinder from directly beneath compartment 82 to a central region 98 between the two bulk straw staging members 12*a* and 12*b*.

Figure 4:
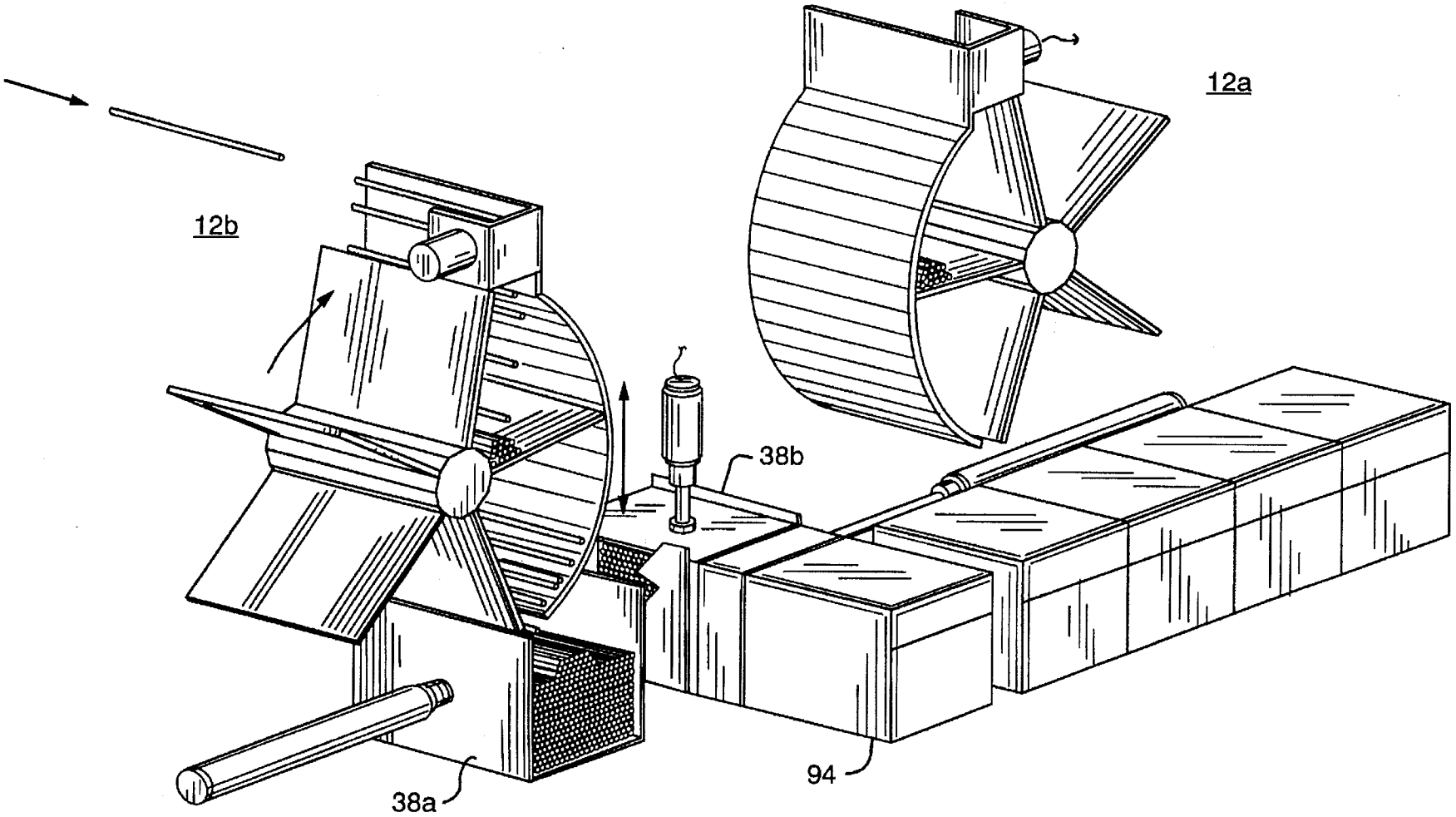
FIG. 4 is a rear view of the bulk straw staging members and bulk straw transport device of FIG. 3.

Once moved into the central region 98, a straw hold down plate 86 is moved into position by a top plate actuator 88 also preferably an air or hydraulic cylinder. The air or hydraulic cylinder moves the top plate 86 upwardly and downwardly as indicated generally by arrow 90. Top plate 86 serves to hold the straws 60 in position within each respective second bulk straw transport device 38*a*–38*b* while actuator 92 pushes the straws 60 into a box or bag 94, FIG. 4 for subsequent delivery to a box or bag closing and sealing assembly, as well known in the art.

Since each bulk straw staging member 12*a*, 12*b* includes enough capacity to store at least two compartments full of straws, the bulk straw transport feature of the present invention can utilize one central staging area 98 to service two bulk straw transport devices 38*a*, 38*b* without the worry of having to quickly cycle the bulk straw transport devices 38*a*, 38*b* from their first position gathering straws from or under each respective bulk straw staging member 12*a*, 12*b*, to the second central position 98.

Figure 5:
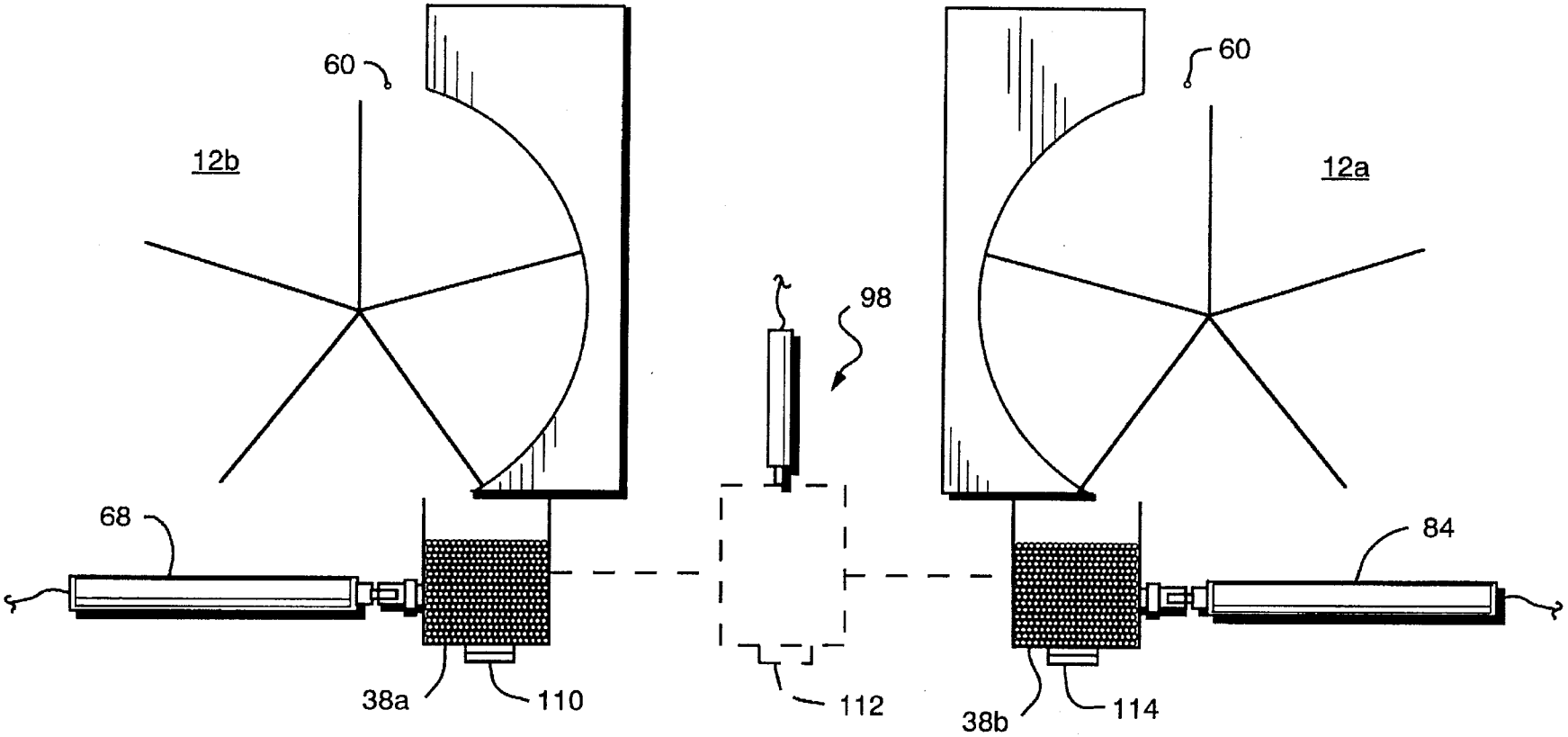
FIG. 5 is a schematic rear view of two bulk straw staging members with a portion of a bulk straw transport device in accordance with the present invention.

Each bulk straw transport device 38*a*, 38*b*, FIG. 5 is shown as a generally square container adapted to contain at least a predetermined quantity of straws such as, for example, 450 straws, although size and shape of the bulk straw transport devices 38*a*, 38*b* is not a limitation of the present invention.

Figure 6:
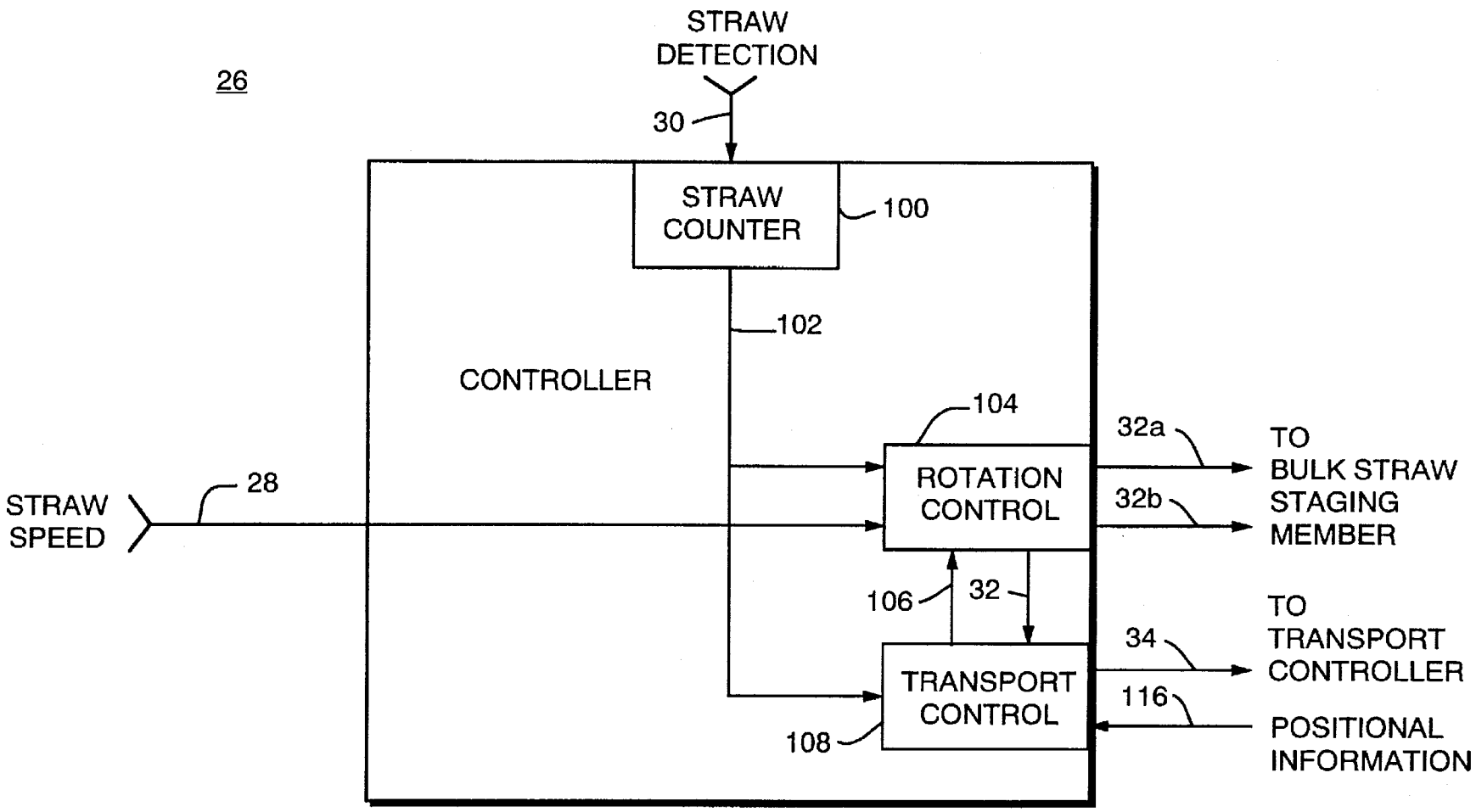
FIG. 6 is a block diagram of the bulk straw loading system controller in accordance with the present invention.

The controller 26, FIG. 6, of the bulk straw loading system in accordance with the present invention includes a straw counter 100 which receives as input straw detection information 30 from each bulk straw staging member 12. Although shown as only one signal path, each bulk straw staging member 12 includes a straw detector and thus will have a separate signal path 30 to straw counter 100 of controller 26. Straw counter 100 keeps track of and accumulates each straw detection 30 and provides a signal 102 when a predetermined straw count, for example, 450+/−1 straw has been reached.

Straw count or signal 102 is provided to a rotation controller 104 which utilizes the straw count information 102 as well as straw speed information 28 received from a source such as a straw cutter, wrapper or extruder, as previously defined, to provide one or more bulk straw staging member motor signals 32*a*, 32*b* to cause each respective bulk straw staging member motor to rotate each respective bulk straw staging member 12.

Rotation control 104 also utilizes positional information 106 received from transport control unit 108 to determine how much to rotate each bulk straw staging member 12. If a bulk straw transport device 38 is available for a given bulk straw staging member 12, slightly more rotation may be effectuated to cause the straws in a given compartment of a respective bulk straw staging member 12 to be unloaded into a bulk straw transport device 38*a*, 38*b*.

Positional information on the position of each respective bulk straw transport device 38*a*, 38*b* is provided by a plurality of positional sensors 110, 112 and 114, FIG. 5, which detect the position of each respective bulk straw transport device 38*a*, 38*b*. Positional information 116 is received from sensors 110–114 and provided to transport control unit 108. Transport control unit 108 utilizes positional information 116 as well as a straw count information 102 and rotational control information 32 to provide one or more signals 34 to transport controller 36, FIG. 1. Transport controller 36 typically includes a source of air or oil to power the several air or hydraulic devices which control movement of the first and second bulk support transport devices 38*a*, 38*d* and which control movement of the top plate actuator 88. As is well known in the art, appropriate electronic circuitry, valves, and one or more detectors may be necessary and included.

Figure 7:
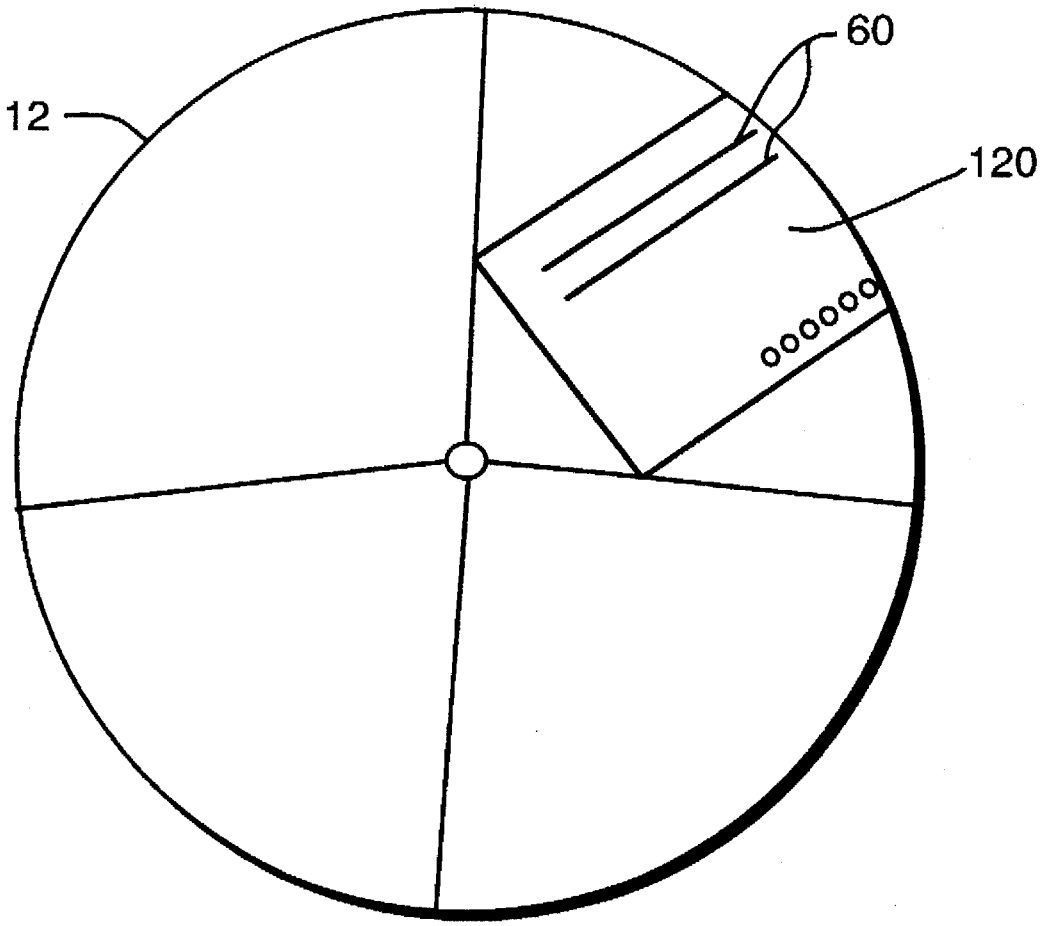
FIG. 7 is a top schematic view of a horizontal embodiment of a bulk straw staging member according to another aspect of the present invention.

Accordingly, the present invention provides one or more bulk straw staging members which allow a plurality of straws to be detected, counted, collected, stored and finally dispensed to a transport device which organizes the straws in a predetermined manner, such as shape, and provides the straws to a packaging device. Although the preferred embodiment of the present invention contemplates the bulk straw staging member disposed generally vertically, a horizontal embodiment of a bulk straw staging member 12, FIG. 7, is also contemplated. Further, although when disclosed vertically the generally triangular shape of each compartment of each bulk straw staging member insures that the straws are stacked in a neat orderly manner, without twisting or turning, in the embodiment shown in FIG. 7 wherein the bulk straw staging member is disposed generally horizontally, the compartments of the bulk straw staging member may be shaped rectangularly as shown generally at 120. In this embodiment, straws 60 may be inserted horizontally within the changer 120 while alternatively, they may be inserted vertically.

Modifications and substitutions by one of ordinary skill in the art are considered to be within the scope of the present invention which is not to be limited except by the claims which follow.

What is claimed is:

1. A bulk straw loading system comprising:

at least one bulk straw staging member, including a plurality of bulk straw staging member compartments, each of said bulk straw staging member compartments for receiving a plurality of straws from a source of straws, and for containing said plurality of said straws;

at least one bulk straw staging member rotator, coupled to said at least one bulk straw staging member, for effecting rotational movement of said bulk straw staging member;

at least one bulk straw transport device, for receiving said plurality of straws from each successive rotated bulk straw staging member compartment, and for transporting said received plurality of straws to a bulk straw packager; and a bulk straw loading system controller, coupled to at least said at least one bulk straw staging member rotator and said at least one bulk straw transport device, and responsive to at least an indication of a rate at which said straws are being received by each of said plurality of bulk straw staging member compartments of said bulk straw staging member, for controlling said at least one bulk straw staging member rotator thereby controlling rotational movement of said bulk straw staging member when a predetermined number of straws are received in each of said plurality of bulk straw staging member compartments, and for controlling transport of said received plurality of straws by said bulk straw transport device such that said bulk straw transport device transports said received plurality of straws while at least a first bulk straw staging member compartment holds a first plurality of straws and at least a second bulk straw staging member compartment receives a second plurality of straws.

2. The bulk straw loading system of claim 1, wherein said at least one bulk straw staging member includes a wheel.

3. The bulk straw loading system of claim 2, wherein an axis of rotation of said wheel is disposed in a horizontal plane.

4. The bulk straw loading system of claim 2, wherein an axis of rotation of said wheel is disposed in a vertical plane.

5. The bulk straw loading system of claim 2, wherein said at least one bulk straw staging member compartments are generally triangular shaped.

6. The bulk straw loading system of claim 2, wherein said at least one bulk straw staging member compartments are generally rectangular.

7. The bulk straw loading system of claim 1, wherein said source of straws provides wrapped straws.

8. The bulk straw loading system of claim 1, wherein each of said plurality of bulk straw staging member compartments includes at least one opening for dispensing said contained plurality of straws.

9. The bulk straw loading system of claim 8, further including at least one bulk straw staging member compartment opening temporary closure member, for closing at least one opening of at least one bulk straw staging member compartment.

10. The bulk straw loading system of claim 9, wherein said bulk straw staging member compartment opening temporary closure member temporarily closes at least two of said bulk straw staging member compartment openings.

11. The bulk straw loading system of claim 1, further including at least one straw counter, for counting the number of straws as said straws are received by said at least one bulk straw staging member.

12. The bulk straw loading system of claim 11, wherein said bulk straw loading system controller is coupled to said at least one straw counter.

13. The bulk straw loading system of claim 1, wherein said source of straws includes a straw cutter.

14. The bulk straw loading system of claim 13, wherein said bulk straw loading system controller is responsive to an indication of a rate at which said straws are being cut by said cutter.

15. The bulk straw loading system of claim 1, wherein said bulk straw loading system controller is responsive to indication of a rate at which said straws are being extruded from a straw extruder.

16. The bulk straw loading system of claim 1, wherein said bulk straw loading system controller counts the number of straws in each said bulk straw staging member compartment.

17. A bulk straw loading system comprising:

at least first and second bulk straw staging members, for receiving a plurality of straws from a source of straws, wherein each of said first and second bulk straw staging members include a plurality of bulk straw staging member compartments, for receiving and containing a plurality of straws;

at least one bulk straw staging member rotator, coupled to each of said first and second bulk straw staging members, for effecting rotational movement of said first and second bulk straw staging members;

at least one bulk straw transport device, for receiving said plurality of straws from each of said first and second staging member compartments, and for transporting said received plurality of straws to a bulk straw packager; and a bulk straw loading system controller, coupled to said at least one bulk straw staging member rotator and said at least one bulk straw transport device, and responsive to at least an indication of a rate at which said straws are being received by said first and second bulk straw staging members, for controlling said at least one bulk straw staging member rotator thereby controlling rotational movement of each of said first and second bulk straw staging members when a predetermined number of straws are received in respective ones of said plurality of bulk straw staging member compartments of said first and second bulk straw staging members, and for controlling transport of said received plurality of straws by said bulk straw transport device from each of said first and second bulk straw staging members, wherein said bulk straw transport device receives said plurality of straws from one of said first and second bulk straw staging members while the other of said first and second bulk straw staging members holds said plurality of straws in one of said plurality of bulk straw staging member compartments.

18. The bulk straw loading system of claim 17 further including first and second bulk straw transport devices, for receiving said plurality of straws from respective said first and second bulk straw staging members, wherein one of said first and second bulk straw transport devices receives said plurality of straws from the respective one of said first and second bulk straw staging members while the other of said first and second bulk straw transport devices transports a received plurality of straws from the respective other one of said first and second bulk straw staging members to said bulk straw packager.

19. A method of loading a plurality of straws using at least one bulk straw staging member having a plurality of bulk straw staging member compartments, said method comprising the steps of:

counting said straws before said straws are received in one of said plurality of bulk straw staging member compartments;

receiving a first plurality of straws in at least a first one of said plurality of bulk straw staging member compartments;

rotating said at least a first one of said plurality of bulk straw staging member compartments after a predetermined number of straws are counted;

holding said first plurality of straws in said at least a first one of said plurality of bulk straw staging member compartments;

receiving a second plurality of straws in at least a second one of said plurality of bulk straw staging member compartments of said at least one bulk straw staging member as said first plurality of straws are held in said at least a first staging member compartment;

transferring said first plurality of straws to a transport device;

rotating said at least a second one of said plurality of bulk straw staging member compartments and holding said second plurality of straws in said at least a second one of said plurality of bulk straw staging member compartments; and transporting said first plurality of straws to a bulk straw packager while said second plurality of straws are held in said at least a second one of said plurality of bulk straw staging member compartments.

20. The method of claim 19 further including the step of controlling rotation of said at least one bulk straw staging member and said at least one transport device in response to the rate at which said straws are being counted.

* * * * *